US008261712B2

(12) United States Patent
Sotiriades

(10) Patent No.: US 8,261,712 B2
(45) Date of Patent: Sep. 11, 2012

(54) AUTOMATIC CHOKE SYSTEM

(75) Inventor: Aleko D. Sotiriades, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 358 days.

(21) Appl. No.: 12/477,681

(22) Filed: Jun. 3, 2009

(65) Prior Publication Data

US 2009/0301072 A1 Dec. 10, 2009

Related U.S. Application Data

(60) Provisional application No. 61/059,239, filed on Jun. 5, 2008.

(51) Int. Cl.
*F02D 41/06* (2006.01)
*F02D 41/00* (2006.01)

(52) U.S. Cl. ..... 123/179.18; 261/39.3

(58) Field of Classification Search ..... 123/179.18, 123/676, 437, 505, 179.16; 261/39.3, 39.4; 60/320

See application file for complete search history.

(56) References Cited

U.S. PATENT DOCUMENTS

| | | | | |
|---|---|---|---|---|
| 2,188,002 | A | 1/1940 | Farr | |
| 2,381,751 | A | 8/1945 | Hunt | |
| 2,694,559 | A | 11/1954 | Gordon et al. | |
| 2,715,500 | A * | 8/1955 | Boyce | 236/101 R |
| 3,230,945 | A * | 1/1966 | Goodyear | 261/39.3 |
| 3,347,216 | A * | 10/1967 | Schultz | 261/39.1 |
| 3,494,598 | A * | 2/1970 | Gordon | 261/39.3 |
| 3,529,585 | A | 9/1970 | Stoltman | |
| 3,828,745 | A | 8/1974 | Medrick | |
| 3,831,567 | A * | 8/1974 | Freismuth et al. | 261/39.3 |
| 3,834,677 | A * | 9/1974 | Hosho | 261/39.3 |
| 3,877,223 | A | 4/1975 | Layton | |

(Continued)

FOREIGN PATENT DOCUMENTS

DE 19715343 A1 10/1998

(Continued)

OTHER PUBLICATIONS

Web Pages of Website of Advanced Cooling Technologies, Inc. (14 pgs. total), obtained at http://www.1-act.com (including associated subweb portions, e.g., http://www.1-act.com/hpphot.html); although each of the web pages was printed on Jun. 5, 2008, all of the web pages are admitted as prior art.

(Continued)

*Primary Examiner* — Mahmoud Gimie
(74) *Attorney, Agent, or Firm* — Whyte Hirschboeck Dudek S.C.

(57) ABSTRACT

In at least some embodiments, the present invention relates to an automatic choke system for use in an engine having a muffler and a choking mechanism that are located remotely apart from one another. The system includes a thermally responsive device, at least one component that serves to connect, at least in part, the device to the choking mechanism, and a further mechanism for conveying heat from the muffler to the device. Additionally, the system in at least one embodiment includes at least one of: (a) a pipe for conveying a fluid from a first location proximate the muffler to a second location proximate the device, the pipe being comprised within the further mechanism; and (b) a rotatable axle that spans a majority of a distance between the first location and a third location that is proximate the choking mechanism, the axle being comprised within the at least one component.

19 Claims, 8 Drawing Sheets

U.S. PATENT DOCUMENTS

| | | | | | |
|---|---|---|---|---|---|
| 3,898,967 | A | * | 8/1975 | Bennett et al. | 261/39.1 |
| 3,906,912 | A | * | 9/1975 | Jackson et al. | 261/39.1 |
| 3,924,591 | A | * | 12/1975 | Bond et al. | 123/547 |
| 4,050,424 | A | * | 9/1977 | Nelson | 261/39.3 |
| 4,050,427 | A | * | 9/1977 | Hollins | 261/39.3 |
| 4,057,604 | A | * | 11/1977 | Rollins | 261/88 |
| 4,068,636 | A | | 1/1978 | Nau et al. | |
| 4,200,069 | A | | 4/1980 | Paulin, Sr. | |
| 4,297,980 | A | | 11/1981 | Bellis | |
| 4,465,640 | A | | 8/1984 | Dougherty | |
| 5,069,180 | A | | 12/1991 | Schmidt et al. | |
| 6,012,420 | A | | 1/2000 | Dykstra et al. | |
| 6,145,487 | A | | 11/2000 | Dykstra et al. | |
| 6,990,969 | B2 | | 1/2006 | Roth et al. | |
| 7,144,000 | B2 | | 12/2006 | Roth et al. | |
| 2009/0146327 | A1 | | 6/2009 | Roth | |

FOREIGN PATENT DOCUMENTS

| | | | | |
|---|---|---|---|---|
| EP | 1323916 | A2 | | 7/2003 |
| GB | 1174791 | A | * | 12/1969 |
| GB | 1174791 | A | | 12/1969 |
| JP | 07158510 | | | 6/1995 |

OTHER PUBLICATIONS

PCT Notification of Transmittal of the International Search Report and the Written Opinion of the International Searching Authority, or the Declaration, based on International Application No. PCT/US2009//003407, date of mailing Jan. 19, 2010 (15 pgs.).

PCT/US2009/003407; Notification Concerning Transmittal of International Preliminary Report on Patentability (Chapter I of the Patent Cooperation Treaty); Dec. 16, 2010; 8 pages.

Notification of First Office Action; Chinese Application No. 200980105189.8; Nov. 9, 2011; 21 pages.

* cited by examiner

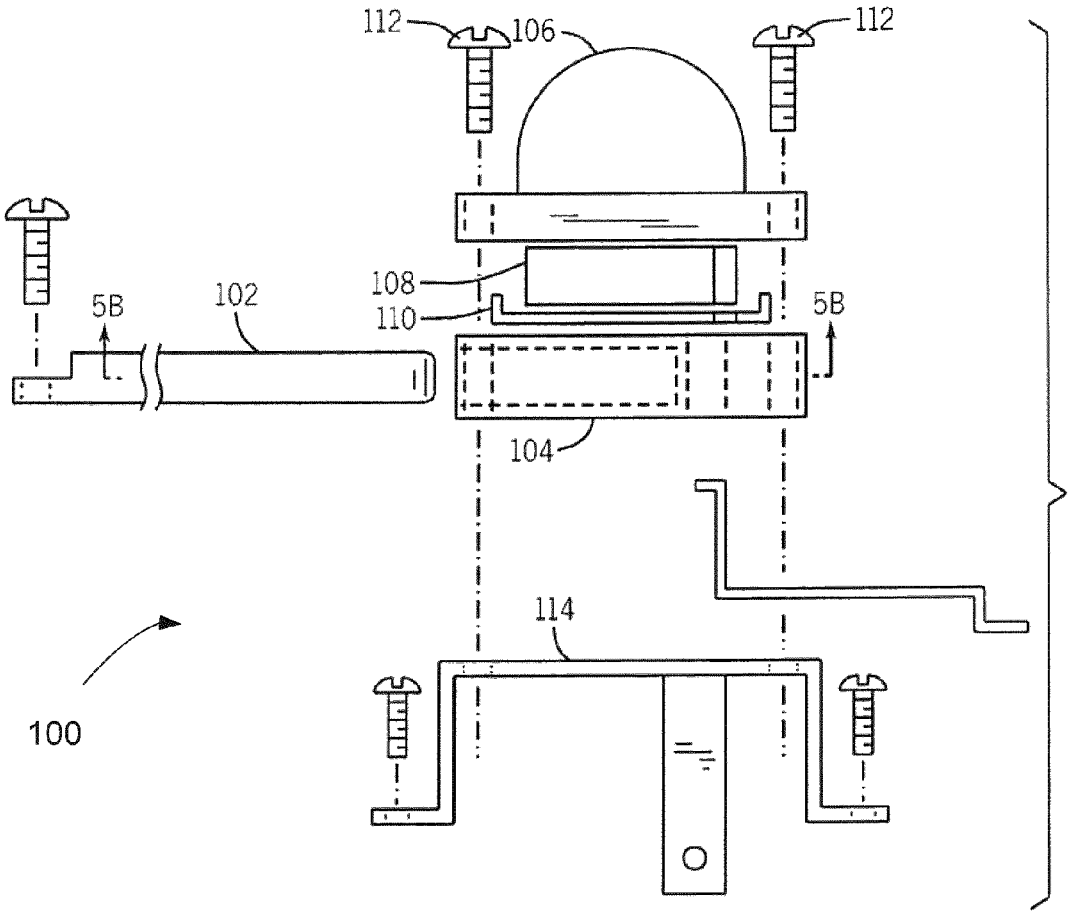
FIG. 5A
FIG. 5B
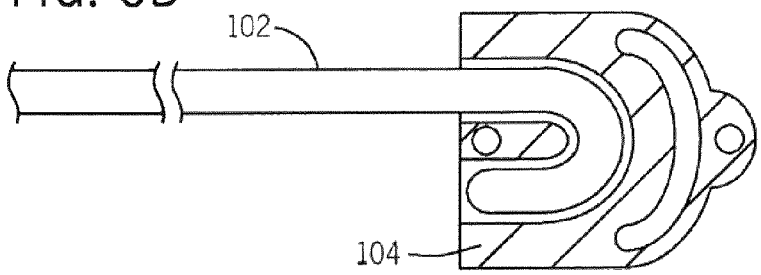

AUTOMATIC CHOKE SYSTEM

CROSS-REFERENCE TO RELATED APPLICATIONS

This application claims the benefit of U.S. provisional patent application No. 61/059,239 entitled "Automatic Choke System" filed on Jun. 5, 2008, which is hereby incorporated by reference herein.

FIELD OF THE INVENTION

The present invention relates to internal combustion engines and, more particularly, to choke systems employed in internal combustion engines.

BACKGROUND OF THE INVENTION

Engine start and run quality at various temperatures is typically dependent on fuel enrichment. A proper variation of fuel enrichment for a naturally aspirated gasoline engine can be achieved by way of a carburetor and a choke plate used in conjunction with one another. Generally speaking, the choke plate is capable of operating to constrict the flow of air into the carburetor inlet, such that the air passing through the constricted inlet passes through a smaller opening resulting in an increased velocity and decreased pressure within the body (venturi) of the carburetor downstream of the inlet. Reducing the pressure through the body (venturi) of the carburetor increases the pressure differential at the fuel source, thereby increasing the amount of fuel flowing into and through the venturi section of the carburetor body.

Typically it is desirable to vary the positioning of a choke plate in an engine depending upon engine operational circumstances. In particular, it typically is desirable to have more fuel entering the engine relative to the amount of air entering the engine when the engine is cold and/or first starting, and so it is commonly the case that a choke plate will be positioned so as to block more air flow at the carburetor inlet under these circumstances (moved to its "closed" position), while positioned so as not to block as much air flow or any air flow at other times (moved to its "open" position). To avoid having to manually adjust the position of the choke plate during start-up and at other running conditions of the engine, automatic choking control systems (also referred to as auto-choke systems or automatic choke systems) are often employed.

Although automatic choke systems are widely employed in the automotive industry, cable controlled choke systems are more common in the small engine industry, particularly small engines employed in consumer applications (e.g., engines for use in lawnmowers, snow throwers, snow blowers, etc.), due largely to the complexity and high cost of existing automatic choke systems. Further, the automatic choke systems that do exist for application in the small engine consumer market are nevertheless inadequate in at least some respects. For example, many conventional automatic choke systems for use in small engines are inadequately designed, such that during operation the systems can result in undesirable engine performance including, for example, generation of black smoke during start-up or during warm-up conditions, contamination of engine oil with fuel, and engine spark plug fouling. Also, many conventional automatic choke systems for small engines do not account for variations in engine and carburetor design that necessitate varying degrees of choking during the restarting of an engine, after the engine has been running, during cool-down of the engine, and under other application load conditions.

It would therefore be advantageous if an improved automatic choke system was designed that could serve to properly choke (or avoid choking) the engine carburetor to achieve or enhance one or more desired types of operational behavior of the engine (e.g., quick start-up) under one or more operational circumstances. In at least some embodiments, it would be advantageous if such an improved automatic choke system was capable of manipulating the choke plate in response to engine temperature and/or engine load demand, was capable of fully opening the choke plate once the engine was fully warm (or at a temperature at which choke is not desired), and/or was capable of adjusting choke operation for start-up, warm-up, restart, cool-down, application load conditions, and/or other conditions. In at least some further embodiments, it would be advantageous if such an automatic choke system was simpler and/or less costly than conventional automatic choke systems.

SUMMARY OF THE INVENTION

In at least some embodiments, the present invention relates to an automatic choke system for use in an internal combustion engine having a muffler and a choking mechanism that are located remotely apart from one another on the engine. The choke system includes a thermally responsive device, at least one component that serves to connect, at least in part, the thermally responsive device to the choking mechanism, and a further mechanism for conveying heat from the muffler to the thermally responsive device. Additionally, the choke system further comprises at least one of: (a) at least one pipe for conveying at least one fluid from a first location that is at least proximate the muffler to a second location that is at least proximate the thermally responsive device, the at least one pipe being comprised within the further mechanism; and (b) at least one physically rotatable axle that spans a majority of a distance between the first location and a third location that is at least proximate the choking mechanism, the at least one physically rotatable axle being comprised within the at least one component.

Further, in at least some embodiments, the present invention relates to an automatic choke system for use in an internal combustion engine having a heat source and a choking mechanism including a choke plate. The choke system includes a first structure that is the thermally responsive, and a second structure connected at least indirectly at a first end to the first structure and at a second end to the choking mechanism. Additionally, the choke system also includes a heat transfer channel at least indirectly linking the heat source to the first structure. The heat transfer channel enables heated air to proceed from the heat source to the first structure and additionally allows for conduction of heat from the heat source to the first structure, whereby heat received at the first structure causes a response at the first structure, which in turn causes the second structure to operate so as to effect a movement of the choking mechanism.

Also, in at least some embodiments, the present invention relates to a heat activated choke system for use in an internal combustion engine having a heat source and a choking mechanism. The choke system includes a module including a thermally responsive first structure, the module being mounted directly upon the heat source such that heat from the heat source is conducted to the thermally responsive first structure. Further, the choke system also includes at least one linking component coupled to the choking mechanism, where actuation of the at least one linking component cause actuation of the choking mechanism. Additionally, the choke system also includes an additional component linking the first structure to the at least one linking component, the additional component spanning a majority of a distance separating the heat source and the choking mechanism, where additional component experiences rotational motion upon actuation of the first structure.

BRIEF DESCRIPTION OF THE DRAWINGS

FIG. 5A is an exploded view of another alternate embodiment of a thermal control system of an automatic choke system that can be employed in an engine such as that shown in FIG. 1, in accordance with at least some additional embodiments of the present invention;

FIG. 5B shows a cross-sectional view, taken along line 5B-5B of FIG. 5A, of portions of the thermal control system of FIG. 5A.

DETAILED DESCRIPTION OF THE PREFERRED EMBODIMENT

Figure 1:
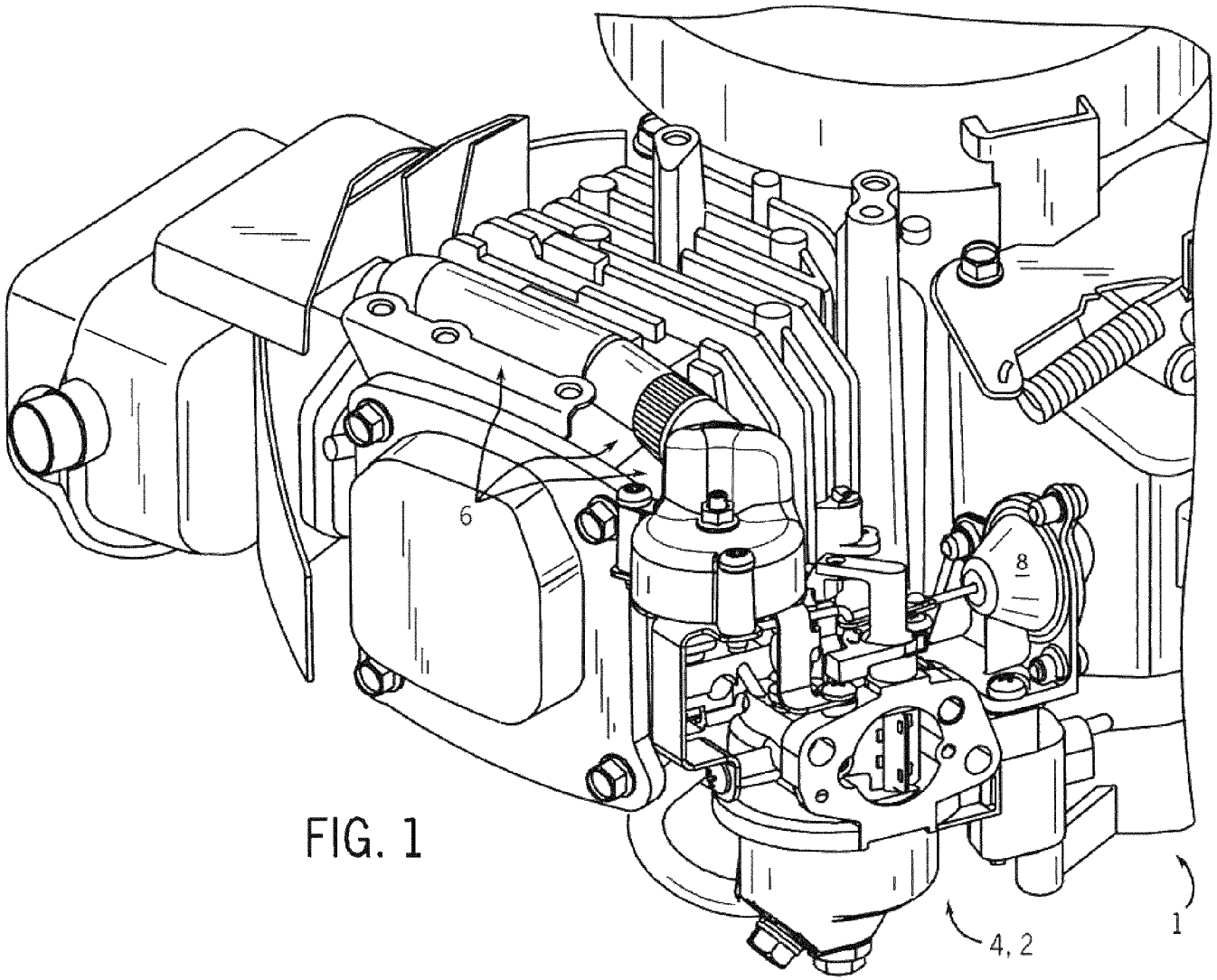
FIG. 1 is a perspective, cutaway view of an internal combustion engine employing an automatic choke system in accordance with at least some embodiments of the present invention.

Referring first to FIG. 1, a perspective, cutaway view of an internal combustion engine 1 is shown in accordance with at least some embodiments of the present invention. As shown in FIG. 1, among other components, the internal combustion engine 1 includes a carburetor 2 on which is mounted an automatic choke system 4. The internal combustion engine 1 can be any of a wide variety of engines. Particularly, the automatic choke system 4 is contemplated for use in, as part of, or in conjunction or combination with a wide variety of engines (not shown) that can employ a carburetor such as the carburetor 2. In other embodiments, the automatic choke system 4 can be employed in other types of engines as well.

Further as shown in FIG. 1 (which shows the engine 1 with a cover removed), the automatic choke system 4 includes a thermal control system 6 and a vacuum control system 8, which are described in greater detail below. Specifically, the thermal and the vacuum control systems 6 and 8, respectively, are employed for the automatic control and adjustment of a rotatable choke plate shaft and arm assembly 14 (see FIGS. 2A and 2B) for achieving proper (or at least enhanced) control over a choke plate of the carburetor 2, thus allowing for proper (or enhanced) engine choking operation over a wide range of temperature and operational conditions and enhancing overall engine performance.

Figure 2A:
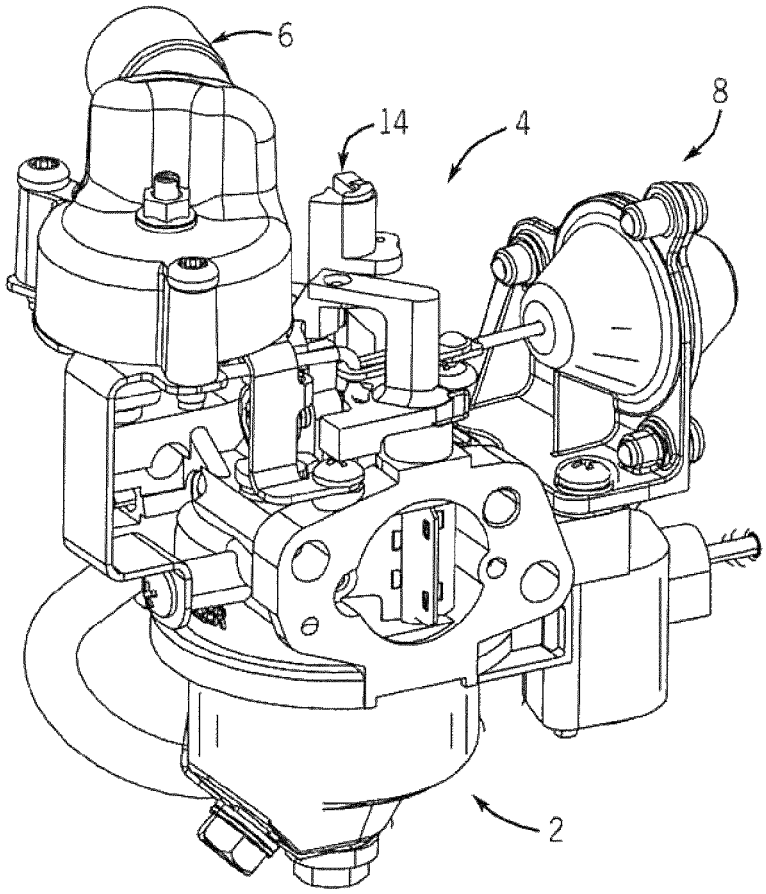
FIG. 2A is a front perspective view of the carburetor and the automatic choke system of FIG. 1 shown in more detail.
Figure 2B:
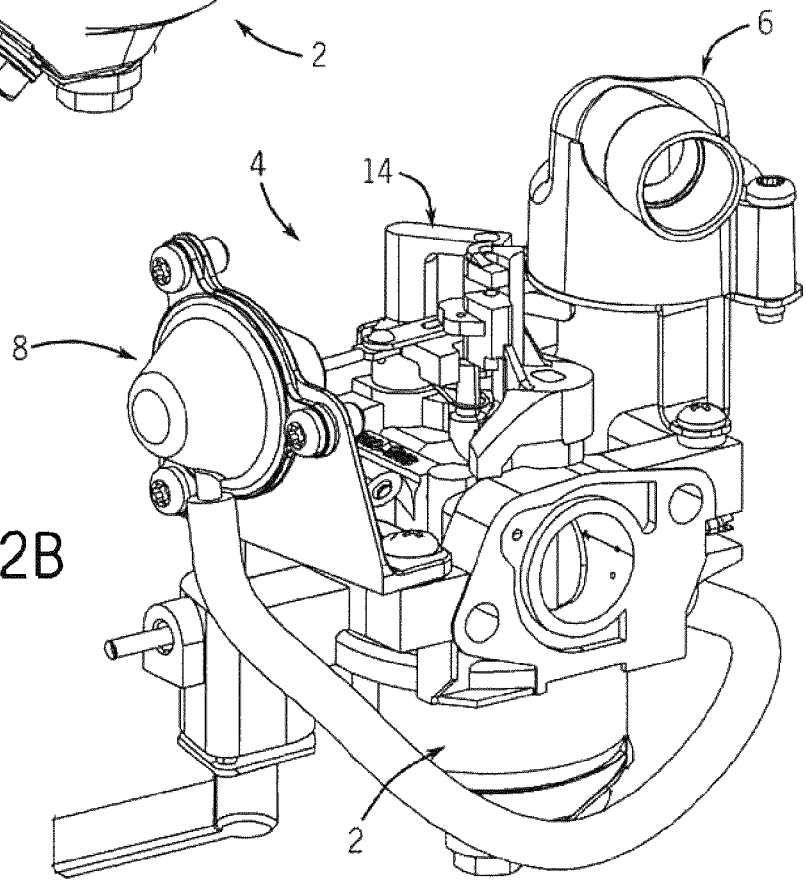
FIG. 2B is a rear perspective view of the carburetor and automatic choke system of FIG. 1 shown in more detail.

Referring now to FIGS. 2A and 2B, a front perspective view and a rear perspective view, respectively, are provided showing the automatic choke system 4 of FIG. 1 having the thermal control system 6 and the vacuum control system 8 mounted on the carburetor 2, in accordance with a first embodiment of the present invention. The automatic choke system 4 and carburetor 2, and particularly the thermal control system 6, are shown in greater detail in FIGS. 3A and 3B, described below.

Figure 3A:
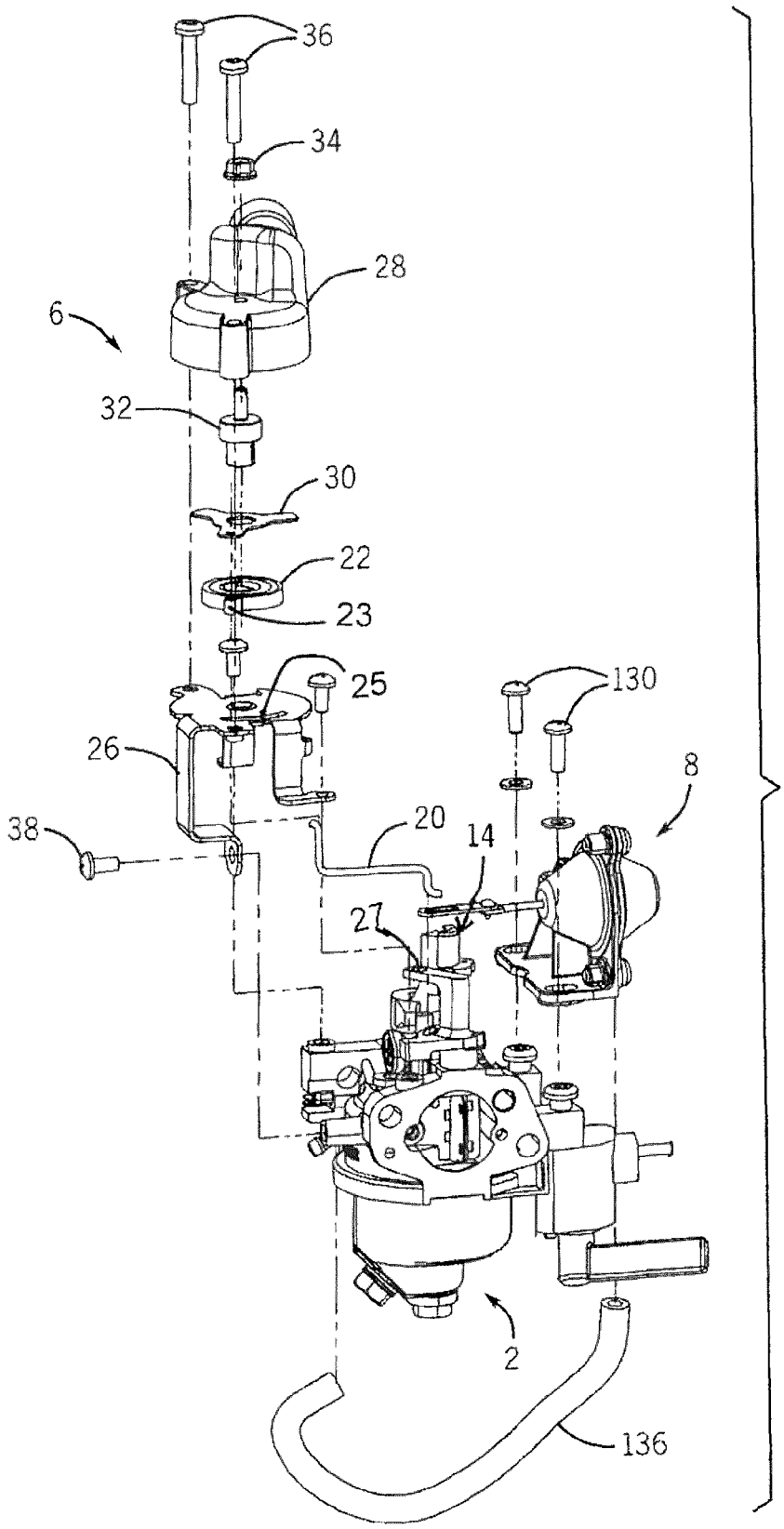
FIG. 3A is an exploded view of certain portions of the thermal control system of the automatic choke system along with the carburetor of FIGS. 2A-2B.

Turning now to FIG. 3A, an exploded view of the automatic choke system 4 of FIGS. 1-2B is provided, which particularly shows in more detail components of the thermal control system 6. As should be evident from FIG. 3A, when the automatic choke system 4 is fully assembled, the rotatable choke plate shaft and arm assembly 14 is attached to a first end of a corrosion resistant (e.g., zinc-plated) steel link 20. As shown, the link 20 can in particular be attached to an orifice 27 on the choke plate shaft and arm assembly 14. The choke plate shaft and arm assembly 14 rotates to and from a closed choke position (and, correspondingly, from and to an open choke position) with a linear-planar motion of the link 20. The link 20 at its second end (opposite its first end) is also tangentially connected to a thermally responsive bimetallic coil spring 22, which is in constant communication with a heat source (e.g., a muffler 24, as will be described with respect to FIG. 3B). More particularly, the link 20 is attached to a formed eyelet 23 of the coil spring 22. As the coil spring 22 expands and contracts in response to heat (or the absence of heat) from the heat source, it unwinds (or winds) resulting in actuation of the link 20 and the linear-planar motion that causes movement of the choke plate shaft and arm assembly 14 and this movement of the choke plate.

Typically, the time it takes to fully actuate (e.g., expand/unwind or contract/wind) the coil spring 22 is a direct function of the engine's ability to reject heat to the environment. Experiments of this effect have proven that the operational time for full actuation of the coil spring 22 is about 2-3 minutes. However, many physical factors have an influence on the time rate of complete actuation, which can result in greater than 2-3 minutes (or in some cases potentially lesser amounts) of time being required for actuation of the coil spring.

The attachment of the link 20 to the coil spring 22 is constrained with the exception to rotate about the formed eyelet 23. The coil spring 22 resides within an enclosure including a corrosion resistant (e.g., zinc-plated) formed steel lower bracket 26 and an upper housing 28 constructed of die-cast aluminum, die-cast zinc or plastic (thermoset or thermoplastic). The lower bracket 26 includes an arc-shaped slot 25 through which the link 20 proceeds so as to reach the formed eyelet 23. The lower bracket 26 additionally includes a raised feature at its central location to support the coil spring 22, which restricts most of the coils of the coil spring from contacting the lower bracket, thereby reducing debris obstruction or undesirable heat transfer. An aluminum dust shield 30 is also employed in the present embodiment to separate the coil spring 22 and link 20 from binding.

With respect to the upper housing 28, depending upon the embodiment it can take various forms and, more particularly, can include various features that serve to retain the coil spring 22. For example, in one exemplary embodiment (not shown), the upper housing 28 is cast to include a slot by which a central tab of the coil spring 22 is captured. Such a cast feature with the slot for engaging the coil spring 22 can be integral to the upper housing 28. While not allowing for any (or at least not much) adjustment to the angular position of the coil spring 22, such a cast feature can be desirable from the standpoints of lowering cost and manufacturing process control. Also, in such an embodiment, the dust shield 30 in addition to restricting binding as described above also can serve to constrain the coil spring 22 from expanding in the radial direction, such that the link 20 maintains proper clearance to a slot in the bracket from which the links extends.

In another exemplary embodiment, which is shown in FIG. 3A, the upper housing 28 can take a different form. More particularly, in this embodiment a corrosion resistant (e.g., zinc-plated steel, stainless steel, or bronze) actuator or rotatable post 32 with a locking nut 34 is employed to allow angular adjustment of the coil spring 22 within the upper housing 28. In alternate embodiments, other variations and mechanisms for holding the coil spring 22 in position within the upper housing 28 can be employed as well.

Regardless of whether the coil spring 22 is retained within the upper housing 28 in either of the above-described exemplary manners or in another manner, the upper housing is fastened to the lower bracket 26. For this purpose, as shown in FIG. 3A, a pair of screws 36 can be used. Depending upon the embodiment, additional screws 36 or other fastening and/or engaging mechanisms can also or instead be employed to connect the upper housing 28 to the lower bracket 26. Additionally mounted upon and supported by the lower bracket 26 are the coil spring 22 (particularly insofar as it is retained by the upper housing 28), the link 20, the dust shield 30, and the actuator and the locking nut 32 and 34, respectively. The lower bracket 26 in turn is attached to the body of the carburetor 2 by way of a screw 38, with the link 20 being coupled to the choke plate shaft and arm assembly 14. In other embodiments, a plurality of the screws and/or other fastening/engaging mechanisms can be employed also or in addition to the screw 38 for the purpose of attaching the lower bracket 26 (and thus all of the other components attached thereto) to the carburetor 2.

Figure 3B:
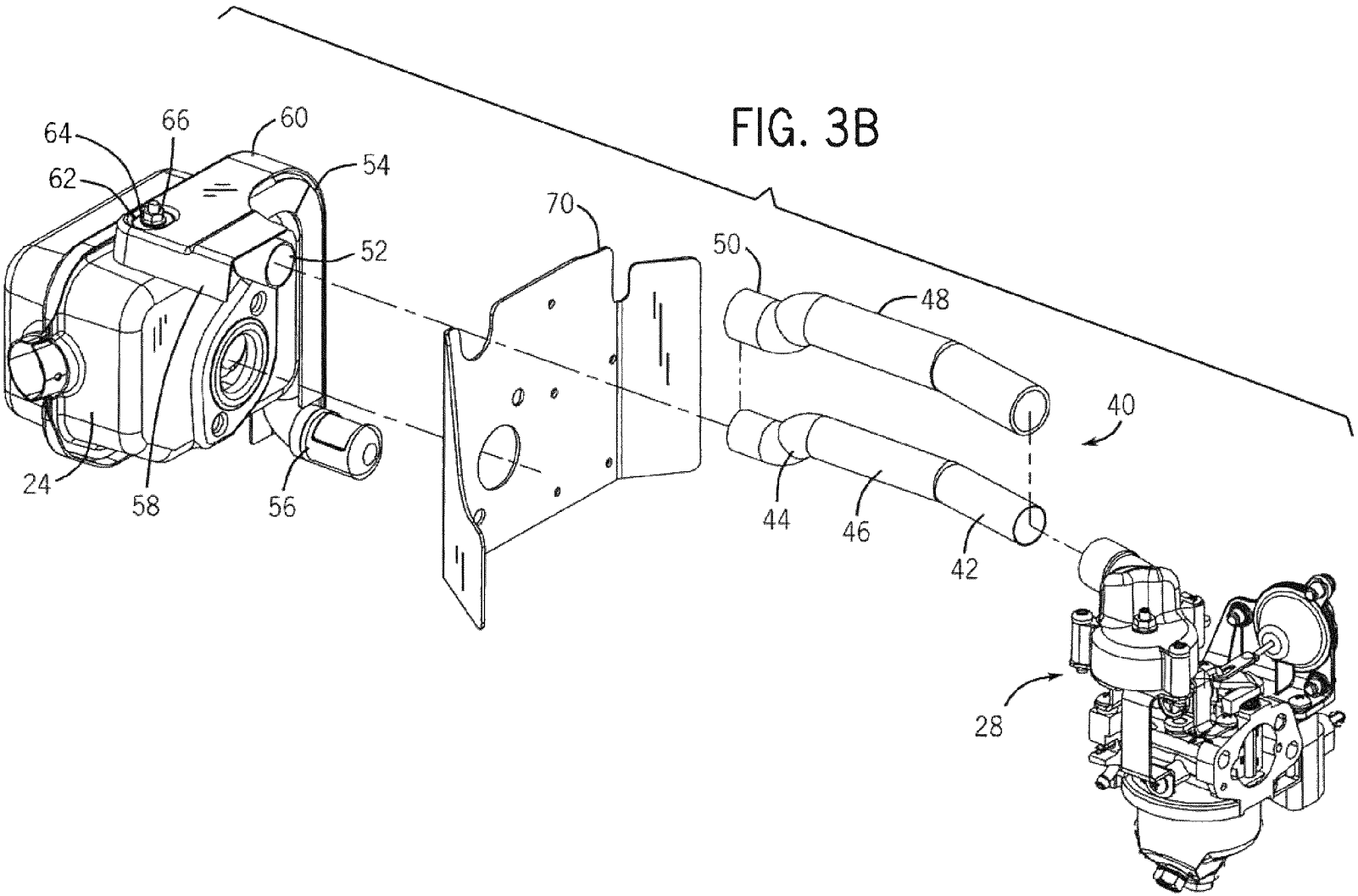
FIG. 3B is an additional exploded view showing additional components of the thermal control system of the automatic choke system and the carburetor of FIGS. 2A-3A.

In order for the coil spring 22 to vary in length/position so as to actuate the choke plate shaft and arm assembly 14, heat (or lack thereof) must be communicated to the coil spring from a heat source. Referring now to FIG. 3B, an additional exploded view 18 is provided showing heat transfer system components by which heat from a heat source is conveyed to the coil spring 22. As shown, in the present embodiment the heat source is the muffler 24 (including certain associated components as discussed further below), and heat is transferred from the muffler 24 to the upper housing 28 by way of a cross-over tube 40. The cross-over tube 40 in particular is a hollow tube that allows air flow to occur therethrough. As will be described further below, by virtue of its design the cross-over tube 40 allows for convective heat transfer (e.g., due to air flow within the tube) and conductive heat transfer to occur between the muffler 24 and the coil spring 22 within the upper housing 28.

The cross-over tube 40 is typically insulated to restrict heat from being radiated away from the tube as it is conveyed by convection and conduction to the coil spring 22 via the upper housing 28. Such insulation of the cross-over tube 40, to achieve a low rate of heat transfer away from the tube, can be provided in several manners. More particularly, as illustrated in FIG. 3B, in at least some embodiments the cross-over tube 40 is a formed corrosion resistant (e.g., zinc-plated) steel tube 42 that is covered with braided fiberglass sleeving 44 and wrapped with fiberglass tape 46 to restrict fraying of the sleeving. Alternatively, although the cross-over tube 40 serves to transfer heat by way of convection (e.g., due to the air flowing therethrough) as well as conduction, in other embodiments conduction by the cross-over tube need not always occur (with convection instead being sufficient) and so the cross-over tube need not always be made out of conductive type materials. Rather, as also illustrated in FIG. 3B, a cross-over tube 48 (which would be a replacement for, rather than be implemented in addition to, the cross-over tube 40) can be instead manufactured from a plastic-type material 50, which can be, for example, thermoplastic (e.g., glass-filled PPA or PA-66) or thermoset plastics. Using the cross-over tube 48, heat loss from inside the tube to the outside environment would be restricted, albeit conduction of heat down the tube would also be restricted. In still alternate embodiments (not shown), other types of tubes constructed from other types of materials for reducing (or possibly eliminating) heat loss can be employed as well.

Further as shown in FIG. 3B, the cross-over tube 40 (or, alternatively, the cross-over tube 48 or another type of tube) connects to an outlet 52 of a heat transfer tube 54, which in the present embodiment is made from a copper or aluminum material having a high coefficient of heat conduction and is capable of being mechanically formed easily. The heat transfer tube 54, although mounted along the exterior surface of the muffler 24, does not conduct exhaust gases or otherwise assist with operation of the muffler. Rather, the heat transfer tube 54 (particularly the walls of the heat transfer tube) serves to receive heat from the muffler 24 (heat source) by conduction. This heat is in turn conducted to the cross-over tube 40 by way of the interfacing between that tube and the outlet 52. Thus, regardless of whether the cross-over tube allows for conduction down its length, conduction at least occurs from the muffler 24 to the air traveling within the heat transfer tube 54 and cross-over tube, via the wall the heat transfer tube.

Additionally, an inlet 56 of the heat transfer tube 54 is positioned to collect ("scoop up") or otherwise receive spent air from the engine's cooling fan (not shown). The inlet 56 of the heat transfer tube 54 in particular is placed downstream not only of the cooling fan but also downstream of the engine cylinder(s) (not shown) over which the fan is blowing air, such that the air received by the inlet of the heat transfer tube is heated due to the heat given off by the cylinder(s), and such that the heated air serves to communicate heat through the heat transfer tube 54 by convection. Thus, the heat transfer tube 54 transfers heat to the cross-over tube 40 by both conduction (e.g., from the muffler 24 through its walls) and convection (e.g., due to the air flowing therethrough).

Also as shown in FIG. 3B, the inlet 56 of the heat transfer tube 54 includes a screen assembly that is intended to protect the heat transport system (e.g., the heat transfer tube 54 and the cross-over tube 40) from dust and small debris, by restricting much (if not all) of such material from entering the inlet; Additionally, to promote the retention of heat within the heat transfer tube 54, an insulating gasket enclosure 58 made of graphite and coated with steel sheet metal (e.g., a composite) can be formed around the top and sides of the heat transfer tube along the muffler 24, such that most if not all of the heat transfer tube is contained within the space formed between the insulating gasket enclosure and the muffler. A corrosion-resistant (e.g., zinc-plated) cover 60 further is provided to protect the insulating gasket enclosure 58. The heat transfer tube 54, insulating gasket enclosure 58 and cover 60 all fit over weld studs 62 extending from the muffler 24, to which those components are fastened securely with nuts 64 and flat washers 66, such that all of those components are fastened securely to the muffler. An additional wall structure 70 can also be employed as an interface between the heat transfer and cross-over tubes 54, 40.

Given the above-described arrangement of FIG. 3B, heat from the muffler 24 is transferred to the coil spring 22 in two manners. First, heat is transferred conductively, from the heat transfer tube 54 to the cross-over tube 40 and then down that tube to the upper housing 28 and the coil spring 22. Additionally, heat is transferred convectively. More particularly, due to the action of the fan, warm air is pushed into the inlet 56 of the heat transfer tube 54. The warm air then proceeds through the heat transfer tube 54, out of the outlet 52, and into the cross-over tube 40 (or other tube). The warm air, which is warmed further by the heat being conducted by the heat transfer tube 54 and the cross-over tube 40, further then proceeds down the cross-over tube 40 to the coil spring 22. The flow of air toward the coil spring 22 not only helps directly to heat the coil spring, but also increases the rate at which the cross-over tube 40 conveys heat to the coil spring by way of conduction. As already discussed, heating (or cooling) of the coil spring 22 causes the coil spring to contract (or expand) in response to the heat transfer, thereby resulting in winding (or unwinding) of the coils of the coil spring. This in turn causes the link 20 to experience the linear-planar motion, which results in movement of the choke plate shaft and arm assembly 14, so as to vary the opening and/or closing of the choke plate.

Notwithstanding the aforementioned description of the thermal control system 6 for conveying heat from the muffler 24 to the coil spring 22 via the cross-over and the heat transfer tubes 40 (or 48) and 54, respectively, the thermal control system need not always employ those tubes for actuation of the choke plate. Rather, in at least some alternate embodiments, various other types of thermal control systems, as will be described in FIGS. 4A to 5B, can be used to vary the position of the choke plate.

Figure 4A:
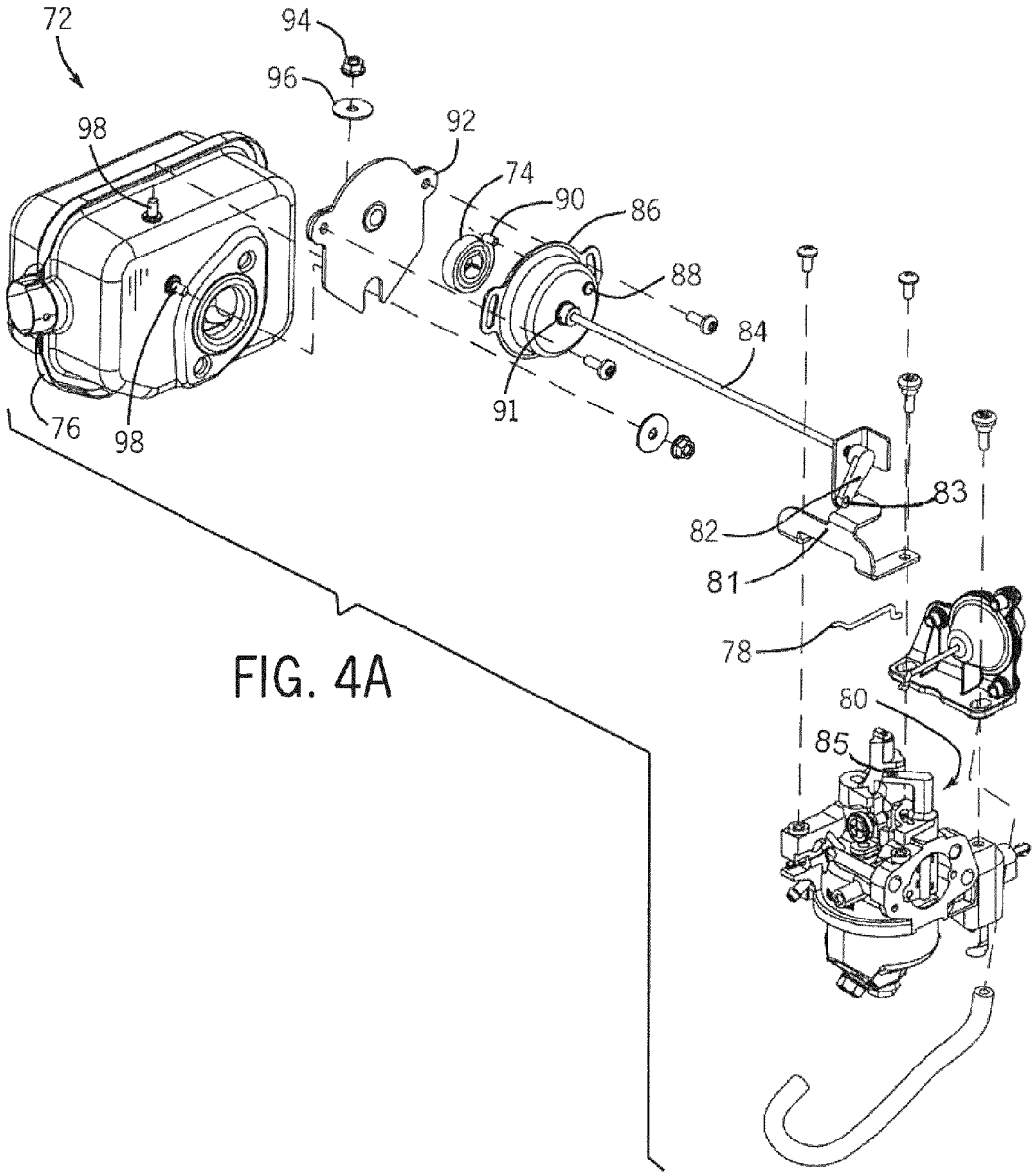
FIG. 4A is an exploded view, from the carburetor end, of an alternate embodiment of a thermal control system of an automatic choke system that can be employed in an engine such as that shown in FIG. 1, in accordance with at least some other embodiments of present invention.
Figure 4B:
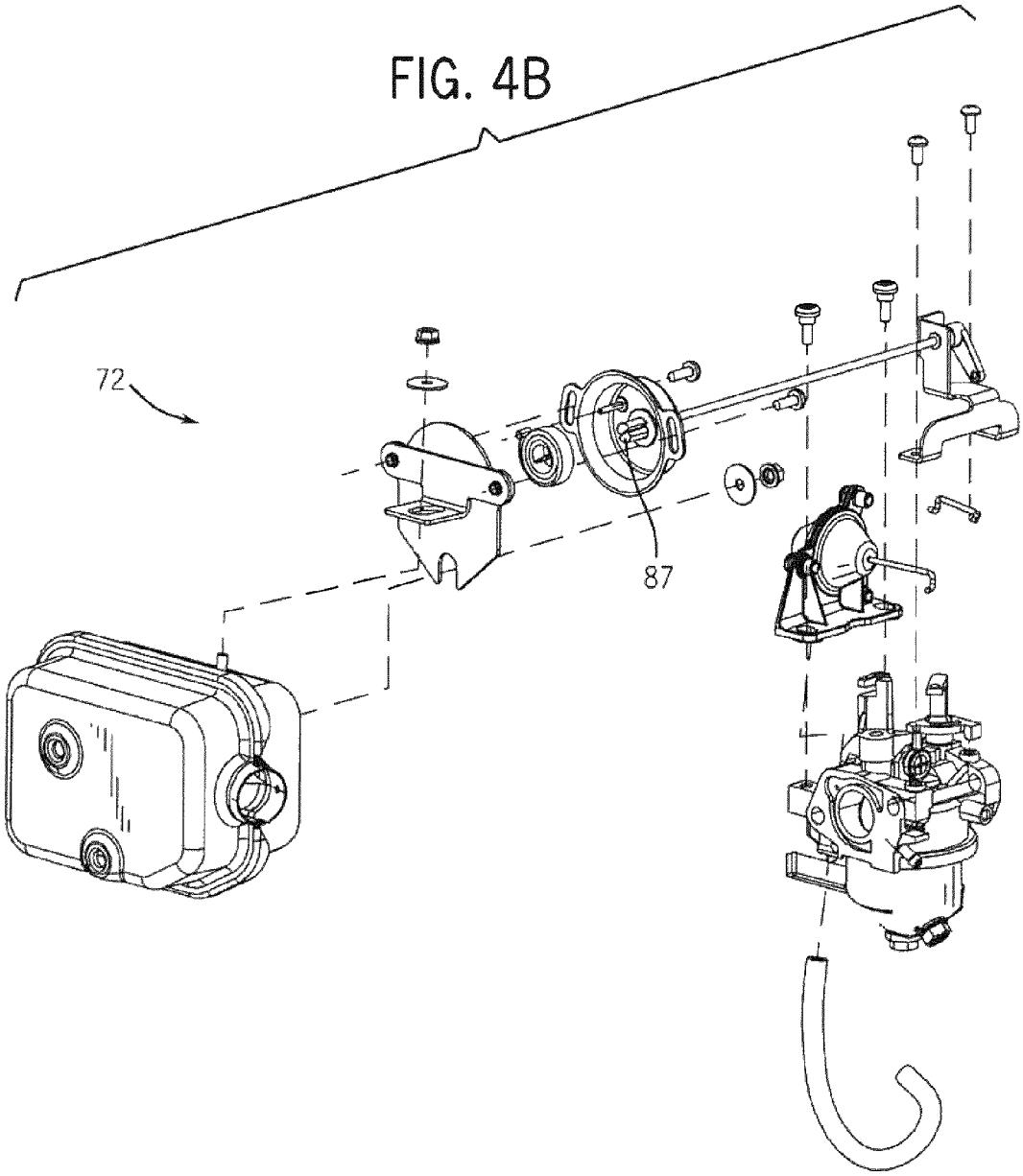
FIG. 4B is an additional exploded view of the thermal control system of the automatic choke system of FIG. 4A as viewed from a heat source end.

Turning specifically to FIGS. 4A and 4B, exploded views showing components of an alternate thermal control system 72 that can be employed with respect to the automatic choke system 4 of FIG. 1 are shown, in accordance with some other embodiments of the present invention. In contrast to the thermal control system 6 described with respect to FIGS. 2A-3B, the thermal control system 72 of FIGS. 4A-4B does not employ any cross-over tube 40 or other mechanism for conveying heat from a muffler to a coil spring. Rather, the thermal control system 72 employs a mechanically actuatable shaft assembly and a bimetallic coil spring 74 that is mounted directly to a muffler 76 (which in alternate embodiments could be another heat source). Additionally, as discussed further below, that shaft assembly in combination with additional components are then employed to mechanically link the coil spring 74 to the engine choke.

More particularly as shown, a corrosion resistant (e.g., zinc-plated or stainless) steel link 78 is attached to a choke plate shaft lever assembly 80 at one end, and to an actuation shaft lever arm 82 at the other end. More particularly, the link 78 is attached to an orifice 83 of the lever arm 82 and to an orifice 85 of the choke plate shaft lever assembly 80. The actuation shaft lever arm 82 is rotationally supported on an aluminum or steel bracket 81. The actuation shaft lever arm 82 can be constructed from die-cast aluminum or plastic and can be affixed or locked to the link 78 in any of a variety of manners including, for example, by way of an interference press fit, by way of a keyed formation that is locked into location with a threaded set-screw, or by being molded directly onto the link. Although not shown, a bushing or bearing made of plastic or other suitable material can be additionally present to facilitate low-friction rotational movement of the arm relative to the bracket (similarly, although not specifically mentioned above or below, other bushings or bearings can also be present at other locations in various embodiments of the present invention to facilitate rotational movement between components). The actuation shaft lever arm 82 in turn is connected (at an end opposite the link 78) to an actuation shaft 84, which itself is constructed from corrosion resistant (e.g., zinc-plated or stainless) steel. The connection between the actuation shaft 84 and the actuation shaft lever arm 82 again can be achieved in any of a variety of manners including, for example, an interference press fit, a keyed formation locked by way of set screws, and molding. Other attaching and/or engaging mechanisms can be employed as well for connecting the actuation shaft lever arm 82 to the actuation shaft 84 and the link 78.

At the other end of the actuation shaft 84 is located a bimetallic spring cover housing 86 for retaining the coil spring 74. The cover housing 86 additionally includes an actuator 87 (see FIG. 4B) located on the inboard side of the coil spring 74, which is machined from corrosion resistant (e.g., zinc-plated or stainless) steel or bronze alloy. Depending upon the embodiment, the actuator 87 is connected to the actuation shaft 84 (and indirectly to the actuation shaft lever arm 82) at a specific orientation with respect to actuation shaft lever arm axis to facilitate proper movement of the coil spring 74. The bimetallic spring cover housing 86 is formed by stamping and is made from sheet metal such as galvanized, zinc-plated or stainless steels or aluminum.

Fixed to the cover housing 86 is a bimetallic spring locating pin 88 made from corrosion resistant (e.g., zinc-plated or stainless) steel. The pin 88 is machined from a material that is sufficiently soft that the pin can be riveted to the cover housing 86. The coil spring 74 has an eyelet 90 at its outermost coil, which fits over the spring locating pin 88 fixing the location of the coil spring relative to the central tab of the spring coil where it is captured by a slot in the actuator 87. The actuation shaft assembly (e.g., the actuation shaft 84 and the actuation shaft lever arm 82) is constrained from translating on the plane parallel to the face of the cover housing 86 by a bearing surface 91 formed at the center of the cover housing, into and through which the actuation shaft fits. Thus, by virtue of connecting the coil spring 74 to the actuator 87 and thereby to the actuation shaft 84, the coil spring is capable of rotating independently for facilitating adjustment of the choke plate.

The coil spring 74 is contained within the cover housing 86 by way of a mounting plate 92, which together with the cover housing forms an enclosure relative to the outside environment and additionally serves to contain heat within the cover housing. In the present embodiment, the mounting plate 92 is formed from corrosion resistant sheet metal such as galvanized, zinc-plated or stainless steel, or aluminum. The mounting plate 92 is additionally affixed to an exterior surface of the muffler 76 by way of hex nuts 94 and washers 96, which are affixed to studs 98 welded to that exterior surface. By virtue of connecting the coil spring 74 (via the mounting plate 92) to the muffler 76, heat conducted from the muffler is able to activate the coil spring 74.

More particularly, heat from the muffler 76 is transferred to the coil spring 74 through the mounting plate 92, thereby resulting in expansion (or contraction) of the coil spring, which in turn leads to unwinding (or winding) of the coils of the coil spring. Since the actuation shaft assembly is free to rotate only (rather than translating across the surface of the cover housing 86), the actuation shaft assembly responds accordingly to the unwinding (or winding) of the coil spring 74, which again is based on temperature changes occurring within the cover housing 86 due to temperature changes experienced by the muffler 76 on which the cover housing is mounted. Thus, due to the unwinding (or winding) of the coil spring 74, the link 78 is moved in a linear plane resulting in movement of the choke plate shaft lever assembly 80 and, consequently, corresponding movement of the choke plate.

Given the above-described design, the thermal control system 72 is a conductive heat transfer system employing a closed system environment design, in contrast to the open system environment design represented by the thermal control system 6 described above in relation to FIGS. 2A-3B. In at least some respects, this closed system environment design is advantageous relative to the open system environment design. In particular, by connecting the coil spring 74 directly to the muffler 76 (directly by way of merely the mounting plate 92), a mechanism for transferring heat from the muffler to the coil spring such as the cross-over tube 40 of the thermal control system 6 is not needed. Thus, the thermal control system 72 offers a lower part count and lower cost with a lower risk of failures associated with the interaction of environmental conditions (e.g., interaction with dust and debris) than does the first embodiment shown in the exploded view.

Turning now to FIGS. 5A and 5B, another thermal control system 100 capable of being employed with respect to the automatic choke system 4 of FIG. 1 is shown in accordance with some alternate embodiments of the present invention. The thermal control system 100 can be considered a modified version of the thermal control system 6 insofar as a coil spring is positioned at the location of the carburetor 2 (also see FIG. 3A) rather than at the location of the muffler 24 (see FIG. 3B) and consequently heat from the muffler must be conveyed to the coil spring. However, while the thermal control system 6 is an open system environment design, the thermal control system 100 is a closed system environment design since, rather than employing the cross-over tube 40 and heat transfer tube 54 allowing for air from the outside environment to be heated (or further heated, assuming that the received air is already somewhat heated due to passage by one or more engine cylinder(s)) and directed toward the coil spring, instead a heat pipe 102 and associated components are employed for this purpose.

More particularly as shown in FIG. 5A, an exploded view of the thermal control system 100 is provided showing how the heat pipe 102 links a heat transfer block 104 at one of its ends to the muffler 24 (not shown in FIG. 5A, but shown in FIG. 3B) at its opposite end. Mounted upon the heat transfer block 104 additionally are a cover housing 106, a bimetallic coil spring 108 and a dust plate 110, with the dust plate generally being positioned between the coil spring and the heat transfer block. The cover housing 106, which extends over and around the coil spring 108 and dust plate 110 so as to enclose those components in relation to the heat transfer block 104, among other things serves to protect the coil spring 108 from direct communication with the environment. The cover housing 106 (which retains the coil spring 108) and the dust plate 110 are connected to the heat transfer block 104 by way of a pair of fasteners 112. Additionally, the heat transfer block 104 is mounted upon (or even possibly integral with) a lower bracket 114 that in turn is mounted upon the carburetor 2 (again as shown, for example, in FIG. 3A). The coil spring 108 is housed, retained, free to un-coil (or coil) and thus actuate the choke plate shaft and arm assembly 14 (again see FIG. 3A), in a manner similar or identical to that described with respect to the first embodiment shown in the exploded view of FIG. 3A.

Referring further to FIG. 5B, a cross-sectional view of the heat pipe 102 and heat transfer block 104 taken along line 5B-5B of FIG. 5A is additionally provided. Typically, the heat pipe 102 is a sealed tube with liquid inside that can conduct heat better than can a hollow tube such as the cross-over tube 40 of FIG. 3B. Upon being heated (e.g., by the muffler 24), the liquid in the tube evaporates and travels along the tube length. Eventually the liquid gives up the absorbed heat, however, and condenses back into liquid, typically within the heat transfer block 104 such that the released heat can heat up (by conduction and/or radiation) the coil spring 108. Subsequently the condensed liquid is returned back to the muffler, where it can be evaporated again. Still referring to FIGS. 5A and 5B, the heat transfer block 104, which connects to the end of the heat pipe 102 opposite the muffler 24, serves to transfer and/or radiate heat into the coil spring 108.

In operating the heat pipe 102 and heat transfer block 104, gravity can be a factor. In particular, if the muffler 24 is physically lower than the heat transfer block 104, condensation of the liquid inside the heat pipe 102 at the opposite or cool end of the heat pipe (that is, proximate the heat transfer block) can easily find its way back to the muffler (e.g., aided by gravity). Nevertheless, if the muffler 24 is physically higher than the heat transfer block 104, the flow of condensed liquid from the cool end back to the muffler is not aided by gravity and another mechanism of returning the condensate to the muffler can be desirable. In at least some embodiments, metallic wicks (e.g., thin bits of metal pieces) are provided, which reside inside the tubing to promote the condensate to flow against gravity back to the muffler, for example, by a capillary or a capillary-like action. In other embodiments, other mechanism(s) for facilitating the flow of condensate from the cool end (the heat transfer block end) to the hot end (muffler end) can be employed as well.

During operation, the heat pipe 102 can have a heat conduction rate that is up to several hundred times the conductive rate of a hollow tube such as the cross-over tube 40. Consequently, the overall diameter and length of the heat pipe 102 can be smaller than those of a cross-over tube while still achieving greater heat conduction. Thus, the use of the heat pipe 102 can provide a smaller and lighter packaging arrangement than is achieved using a comparable cross-over tube. Generally, any of a wide variety of heat pipes that are commonly available or frequently used can be employed. Additionally, due to the higher conduction associated with the heat pipe 102, actuation of the coil spring 108 can proceed at a higher speed.

Figure 6:
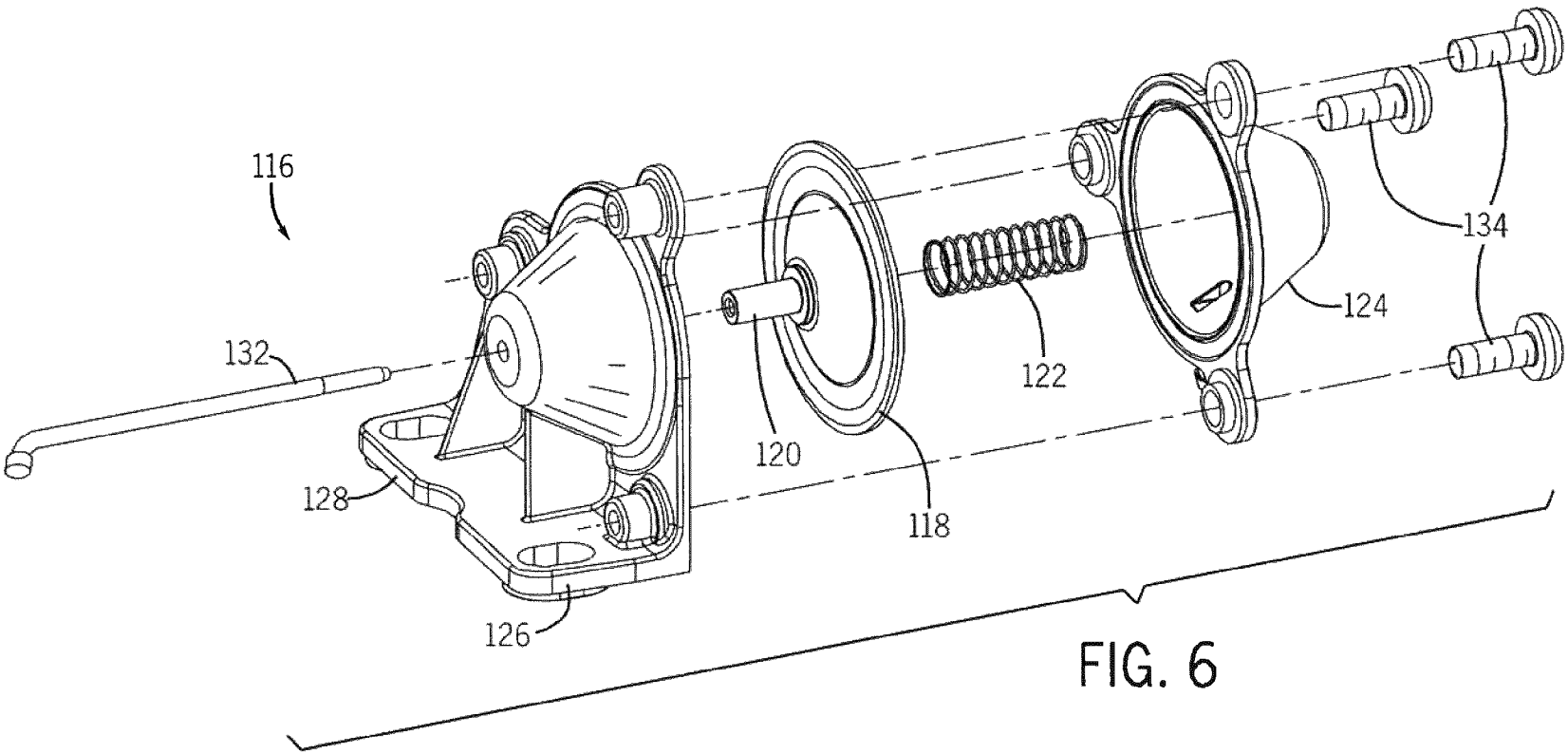
FIG. 6 is an exploded view of the vacuum control system of the automatic choke system of FIG. 1, in accordance with at least some embodiments of the present embodiment.

Turning now to FIG. 6, an exploded view is provided showing exemplary components 116 of the vacuum control system 8 of the automatic choke system 4. The vacuum control system 8 works independently of the various thermal control systems described in FIGS. 2A-5B resulting in immediate actuation of the choke plate to a desired angular position. More specifically, the vacuum control system 8 is a mechanical mechanism that serves to open the choke plate using engine vacuum (a vacuum pull-off assembly), which works independently of any thermally activated bi-metallic control mechanism.

Typically, the function of the vacuum control system is to instantly, but not fully, open the choke plate upon start-up of the engine and the resulting vacuum. The purpose of this operation is to provide enhanced run quality, since the engine's demand for added fuel is the highest at the onset of cranking, just prior to start-up. This is even more evident with colder temperatures. Ideally, after start-up a reduction of fuel enrichment can be tolerated but not completely eliminated until the engine has reached a higher operating temperature or stable speed or combination of both, which allows for less choke. The rotation angle to which the vacuum assembly opens the choke plate is generally predetermined, but can also be varied. In any event, typically the partial opening of the choke plate by the vacuum control system 8 is later superceded with further (full) opening of the choke plate by a thermal control system once sufficient engine heating has occurred.

As shown, the components 116 of the vacuum control system 8 includes a gasoline impervious rubber (Nitrile, fluorinated silicone and other similar materials) diaphragm 118. Further as shown, a boss structure 120 is positioned adjacent to the diaphragm 118, on a front side (particularly the left side as shown in FIG. 6) of the diaphragm. The boss structure 120 is in fixed contact with the diaphragm and, in one embodiment, is sealed to the diaphragm using an epoxy or by way of another manner of fastening. Positioned up against the center of the diaphragm 118, on a rear side (particularly the right side as shown in FIG. 6) of the diaphragm, is additionally a spring 122. The spring 122 can be kept in place relative to the diaphragm 120 (e.g., kept from moving radially outward away from a center of the diaphragm) by forming a pocket or circular ridge along the side of the diaphragm into which an end of the spring fits.

Notwithstanding the above description, in another embodiment an additional spring cup can be positioned along the rear side (i.e., the right side as shown in FIG. 6) of the diaphragm for receiving the spring 122 and holding it in place relative to the diaphragm. In such embodiment, the spring cup can be coupled to the boss structure 120 by way of a rivet extending through a hole in the diaphragm itself. By tightly coupling the boss structure 120 and the spring cup toward one another and up against the sides of the diaphragm, a seal can be maintained between the two sides of the diaphragm notwithstanding the hole in the diaphragm. It should be noted that each of the boss structure 120 and the spring 122 (as well as any spring cup in embodiments where such structure is present) can be made from corrosion resistant steel (e.g., zinc-plated or stainless steel), among other materials.

Further as illustrated by FIG. 6, when the components 116 are assembled, the rubber diaphragm 118 is additionally sandwiched between a rear cover housing 124 and a front cover housing 126. The rear cover housing 124 includes a formed pocket on its interior (not shown) for receiving the end of the spring 122 that is opposite the end of the spring that is proximate the diaphragm 118. The front cover housing 126 serves to seal the rear cover housing 124 from the atmosphere. By virtue of the front cover housing 126, the rear cover housing 124 and the rubber diaphragm 118, a vacuum chamber is formed within a rear cavity or hemisphere formed by the rear cover housing and the diaphragm (within which is situated the spring 122), while an atmospheric-pressure chamber is formed within a front cavity or hemisphere formed by the front cover housing and the diaphragm. The front cover housing 126 additionally includes mounting feet 128 formed integrally therewith for attaching to the carburetor body via screws 130 (see FIG. 3A).

Both of the front and rear cover housings, 126 and 124, respectively, can be made from injection molded plastics such as glass-filled PPA, PA-66, or from die-cast aluminum or die-cast zinc or formed from corrosion resistant (e.g., zinc plated or stainless) steel plate. An adjustable link 132 threads into the central section of the boss structure 120 (which can be considered a diaphragm actuator). The complete vacuum control system 8 is held together with screws 134 and the rear hemisphere (e.g., the cavity formed by the rear cover housing 124) is sealed by the diaphragm bead about its perimeter. A hose 136 (see FIG. 3A) connects between the rear hemisphere and a vacuum port at the carburetor body to communicate with the engine air pressure stream. The link 132 (see FIG. 3A) attaches into the slot of the choke plate shaft and arm assembly 14 (again see FIG. 3A).

Given this design, upon engine start-up, a vacuum pressure within the carburetor 2 is communicated to the sealed-off chamber formed between the diaphragm 118 and the rear cover housing 124 by way of the hose 136. This in turn causes movement of the diaphragm away from a normal position as biased by the spring 122. Movement of the diaphragm in turn causes movement of the link 132, which in turn causes movement of the choke plate shaft and arm assembly 14 and thus the choke plate.

Notwithstanding the embodiments of the automatic choke system described above with respect to FIGS. 1-6, it is an intention of this invention to encompass a variety of arrangements including a variety of refinements and/or additional features to the embodiments described above. Additionally, the exact shapes, sizes and materials of the various components described above can vary depending upon the embodiment and the application employing the automatic choke system. For example, although the various components of FIGS. 1-6 have been described as being constructed of specific materials, it should be understood that in other embodiments, other types of materials can be employed as well. Although the above description primarily focuses upon embodiments in which the heat source providing heat for actuating the coil spring is the muffler (and/or the heat transfer tube associated therewith), in other embodiments one or more other engine components can be used to provide heat instead of, or in addition to, the muffler (e.g., an exhaust manifold). Further, while a coil spring is discussed above as being a thermally responsive device, in other embodiments other thermally responsive components can be used instead of, or in addition to, such a coil spring. Although some embodiments of the present inventive automatic choke system have both a thermal control system and a vacuum control system, other embodiments need only have one of these systems.

Further, as already noted, the automatic choke system can be employed in a variety of types of engines. For example, in at least some embodiments, the automatic choke system 4 can be used in the Courage family of vertical and/or horizontal crankshaft engines available from the Kohler Company of Kohler, Wis. Also, in at least some embodiments, the automatic choke system can be employed in conjunction with SORE engines including Class 1 and Class 2 small off-road engines such as those implemented in various machinery and vehicles, including, for example, lawnmowers, air compressors, and the like. Indeed, in at least some such embodiments, the present invention is intended to be applicable to "non-road engines" as defined in 40 C.F.R. §90.3, which states in pertinent part as follows: "Non-road engine means . . . any internal combustion engine: (i) in or on a piece of equipment that is self-propelled or serves a dual purpose by both propelling itself and performing another function (such as garden tractors, off-highway mobile cranes, and bulldozers); or (ii) in or on a piece of equipment that is intended to be propelled while performing its function (such as lawnmowers and string trimmers); or (iii) that, by itself or in or on a piece of equipment, is portable or transportable, meaning designed to be and capable of being carried or moved from one location to another. Indicia of transportability include, but are not limited to, wheels, skids, carrying handles, dolly, trailer, or platform."

Also, it is contemplated that embodiments of the present invention are applicable to engines that have less than one liter in displacement, or engines that both have less than one liter in displacement and fit within the guidelines specified by the above-mentioned regulations. In still further embodiments, the present invention is intended to encompass other small engines large spark ignition (LSI) engines, and/or other larger (mid-size or even large) engines.

It is specifically intended that the present invention not be limited to the embodiments and illustrations contained herein, but include modified forms of those embodiments including portions of the embodiments and combinations of elements of different embodiments as come within the scope of the following claims.

I claim:

1. An automatic choke system for use in an internal combustion engine having a muffler and a choking mechanism that are located remotely apart from one another on the engine, the choke system comprising:

a thermally responsive device; and at least one component that serves to connect, at least in part, the thermally responsive device to the choking mechanism, wherein the choke system further comprises at least one of:

(a) at least one pipe for conveying at least one fluid from a first location that is at least proximate the muffler to a second location that is at least proximate the thermally responsive device, wherein either (i) the at least one fluid includes air that is fan-propelled through the at least one pipe and convectively transfers heat given off by the muffler from the first location to the second location, or (ii) the at least one pipe includes a heat pipe extending from the first location to the second location and the at least one fluid includes a fluid that has an appropriate boiling point such that, upon the heat being given off by the muffler and reaching the heat pipe, the fluid evaporates and proceeds through the heat pipe to the second location, at which the fluid condenses and gives off the heat, the heat in turn affecting the thermally responsive device; and (b) at least one physically rotatable axle that spans a majority of a distance between a fourth location and a third location that is at least proximate the choking mechanism, the at least one physically rotatable axle being comprised within the at least one component, wherein the thermally responsive device is positioned at the fourth location and the fourth location is directly adjacent to the muffler such that the heat is conductively transferred from the muffler to the thermally responsive device.

2. The automatic choke system of claim 1, wherein the thermally responsive device includes a coil spring.

3. The automatic choke system of claim 1, wherein (a)(i) is true and the at least one pipe includes a tube that is capable of conveying the air from the first location to the second location.

4. The automatic choke system of claim 3, wherein the tube receives the air from an additional tube extending proximate the muffler, wherein the additional tube in turn receives the air at an inlet and the air is warmed due to a flowing of the air proximate at least one engine cylinder prior to entry at the inlet.

5. The automatic choke system of claim 4, wherein the tube is at least partly formed from a heat-conducting material such that additional heat given off by the muffler upon being provided to the tube is conducted down the tube to the second location.

6. The automatic choke system of claim 1, wherein (a) is true and wherein the at least one pipe is selected from at least one of a metallic, heat-conducting tube and a plastic, heat-insulating tube.

7. The automatic choke system of claim 1, wherein (b) is true, and wherein actuation of the thermally responsive device rotates the axle, which in turn at least indirectly actuates the choking mechanism.

8. The automatic choke system of claim 1, further comprising a supplemental vacuum choke system, whereby upon starting of engine operation, a vacuum developed by the engine affects operation of the vacuum choke system so as to reduce an amount of choking performed by the choking mechanism.

9. An engine comprising the automatic choke system of claim 1, wherein the engine is at least one of a single-cylinder engine and a multi-cylinder engine, and at least one of vertical crankshaft engine and horizontal crankshaft engine.

10. The automatic choke system of claim 1, wherein the heat given off by the muffler is conducted from the muffler to the thermally responsive device via a mounting plate.

11. The automatic choke system of claim 1, wherein the at least one pipe includes the heat pipe extending from the first location to the second location and the at least one fluid includes the fluid that has the appropriate boiling point such that, upon the heat being given off by the muffler and reaching the heat pipe, the fluid evaporates and proceeds through the heat pipe to the second location, at which the fluid condenses and gives off the heat, the heat in turn affecting the thermally responsive device.

12. An automatic choke system for use in an internal combustion engine having a heat source and a choking mechanism including a choke plate, the choke system comprising:

a first structure that is thermally responsive;

a second structure connected at least indirectly at a first end to the first structure and at a second end to the choking mechanism;

a heat transfer channel at least indirectly linking the heat source to the first structure, wherein the heat transfer channel enables fan-propelled heated air to proceed from the heat source to the first structure and thereby allows for convection of first heat to the first structure, and additionally allows for conduction of second heat from the heat source to the first structure, whereby the first and second heat received at the first structure causes a response at the first structure, which in turn causes the second structure to operate so as to effect a movement of the choking mechanism.

13. An engine comprising the automatic choke system of claim 12, wherein the heat source is a muffler.

14. The engine of claim 13, wherein the heat transfer channel receives the heated air from an additional channel that at least partially surrounds the muffler.

15. The automatic choke system of claim 12, wherein the thermally responsive first structure is a coil spring having a plurality of coil members, such that the coil spring expands and contracts in response to the first and second heat from the first heat transfer channel, resulting in unwinding and winding, respectively, of the coil members of the coil spring to actuate the second structure.

16. The automatic choke system of claim 12, wherein the second structure includes a corrosion resistant steel link capable of a linear-planar motion in response to the actuation of the first structure, the linear-planar motion of the steel link causing the opening or closing of the choke plate.

17. The automatic choke system of claim 12, further comprising a vacuum pull-off assembly, the assembly comprising:

a housing structure having a front portion and a rear portion;

a first structure positioned within the housing structure and connected at least indirectly to at least one of the front and the rear portions;

a second structure connected at least indirectly to an outer surface of the front portion of the housing structure and away from the first structure;

a third structure having a first end and a second end, the first end being connected to a carburetor of the engine, and the second end being connected to the rear portion of the housing structure;

wherein a vacuum created within the third structure by the carburetor of the engine actuates the first structure, resulting in movement of the second structure to open or close the choke plate additionally connected at least indirectly to the second structure.

18. A heat activated choke system for use in an internal combustion engine having a heat source and a choking mechanism, the choke system comprising:

a module including a thermally responsive first structure, the module being mounted directly upon the heat source such that heat from the heat source is conducted to the thermally responsive first structure, wherein the heat source is a muffler;

at least one linking component coupled to the choking mechanism, wherein actuation of the at least one linking component cause actuation of the choking mechanism; and an additional component linking the first structure to the at least one linking component, the additional component spanning a majority of a distance separating the heat source and the choking mechanism, wherein the additional component experiences rotational motion upon actuation of the first structure.

19. The heat activated choke system of claim 18, wherein the at least one linking component includes at least one lever that is actuated by the rotational motion of the additional component and in turn causes the actuation of the at least one linking component.

* * * * *